United States Patent [19]

Tuan

[11] Patent Number: 5,061,201

[45] Date of Patent: Oct. 29, 1991

[54] CONTACT ELEMENT OF ELECTRICAL CONNECTOR HAVING HIGH CLAMPING FORCE

[76] Inventor: Kenny Tuan, 5F, No. 30, Lane 423, Yuan-San Road, Chung-Ho City, Taipei Hsien, Taiwan

[21] Appl. No.: 681,352

[22] Filed: Apr. 8, 1991

[51] Int. Cl.[5] ..... H01R 13/00

[52] U.S. Cl. ..... 439/326

[58] Field of Search ..... 439/296, 326, 682, 660, 439/629-637

[56] References Cited

U.S. PATENT DOCUMENTS 4,737,120 4/1988 Grabbe et al. ..... 439/326

4,953,448 9/1990 Stanevich ..... 439/326

*Primary Examiner*—Joseph H. McGlynn

[57] ABSTRACT

A contact element of electrical connector includes a S-shaped clamping member sinuously protruding sidewardly from a base portion embedded in a slot of a connector base of the electrical connector, and a L-shaped clamping member protruding sidewardly from the base portion to generally encompass the S-shaped clamping member so as to increase a length of each clamping member to increase a force arm of each clamping member for enhancing the clamping force of the two clamping members in order to enhance an electrical connecting property of the connector.

5 Claims, 5 Drawing Sheets

CONTACT ELEMENT OF ELECTRICAL CONNECTOR HAVING HIGH CLAMPING FORCE

BACKGROUND OF THE INVENTION

Juntwait disclosed "Electrical Contact Pins and Assemblies" in his U.S. Pat. No. 4,826,446 having one contact arm generally formed as C shape 22c for clamping a printed circuit board with another contact arm 23, which however can not develop a strong elastic force for clamping a circuit board since the C-shaped contact arm 22c is too short to have a longer force arm, thereby limiting its elasticity and clamping force. Similarly, a C-shaped curved spring 50 of U.S. Pat. No. 4,946,403 taught by Billman et al does not have a very long force arm and can not increase an elasticity of the contact terminals 10 of connector 2.

Kuhn et al and Billman et al respectively disclosed two opposed cantilever beams each being deflectable upon insertion of a circuit panel between the cantilever beams in their U.S. Pat. Nos. 4,722,700 and 4,973,270. However, such two opposed cantilevers are so symmetrically vertically erected on a base section so that they are suitable for clamping a circuit panel directly latched in a panel support member of the connector, and are not suitable for inclinedly rotating a circuit panel in a tilted panel holder. If it is inferentially to rotatably mount a circuit board inclinedly on a tilted latch of an electrical connector as clamped by the two opposed beams, the curved transition portions 24', 24 or loop sections 12c may be possibly overstressed to cause permanent set or deformation of the terminals, thereby affecting their clamping effect.

The present inventor has found the drawbacks of the conventional connectors, and invented the present contact element for use in an electrical connector having elongate clamping members with increased force arm for increasing a clamping force of the contact element.

SUMMARY OF THE INVENTION

The object of the present invention is to provide a contact element of electrical connector including a S-shaped clamping member sinuously protruding sidewardly from a base portion embedded in a slot of a connector base of the electrical connector, and a L-shaped clamping member protruding sidewardly from the base portion to generally encompass the S-shaped clamping member so as to increase a length of each clamping member to increase a force arm of each clamping member for enhancing the clamping force of the two clamping members in order to enhance an electrical connecting property of the connector.

DETAILED DESCRIPTION

Figure 1:
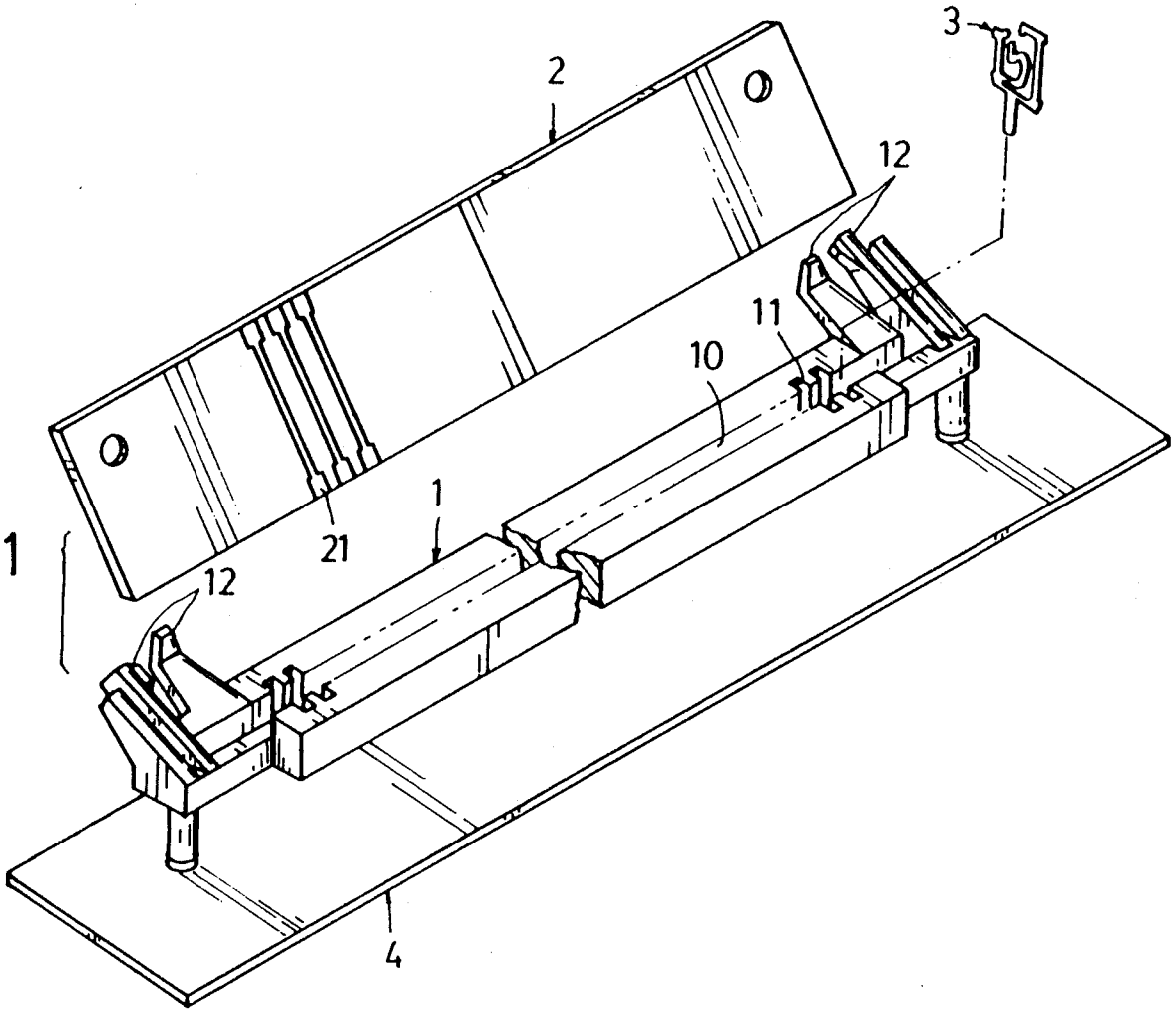
FIG. 1 is a perspective view of an electrical connector of the present invention.
Figure 2:
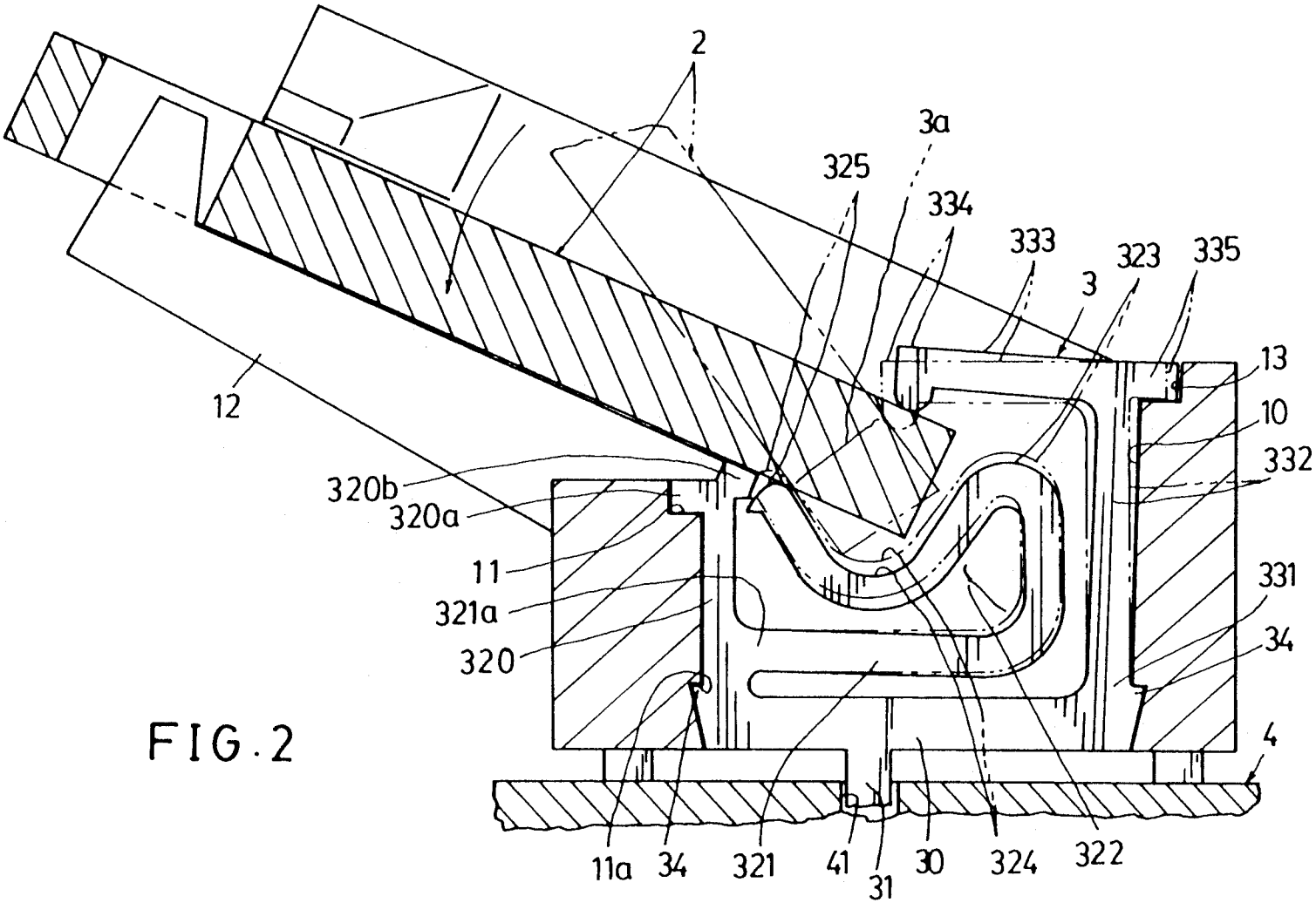
FIG. 2 is a sectional drawing of the present invention.

As shown in FIGS. 1, 2, the present invention comprises a plurality of contact elements 3 respectively inserted in a plurality of slots 11 transversely formed in an elongate socket 10 longitudinally formed in a connector base 1 secured with a mother board 4 for connecting a daughter printed circuit board 2 inserted in the socket 10 to be clamped and held by the plurality of the contact elements 3 of the present invention. The daughter printed circuit board 2, having conducting areas 21 formed on two lower edges of the daughter board 2 to be clamped by the contact element 3, is mounted on the connector base 1 as retained between a pair of fixing protrusions or latches 12 respectively formed on two opposite end portions of the connector base 1. The contact element 3 of the present invention is formed as a thin plate made of electrically conductive materials.

As shown in FIG. 2, the contact element 3 of the present invention comprises: a base portion 30 having a supporting leg member 31 protruding downwardly from a bottom surface of the base portion 30 through a leg hole 41 formed in the mother board 4, at least an embedding portion 34 secured to the base portion 30 generally formed with a ratchet tooth or wedge portion engageable in a recess or slot 11*a* formed in the connector base, a first clamping member 32, and a second clamping member 33. The two clamping members 32, 33 are sidewardly protruded from the base portion 30 which is held in the socket 10 in the connector base 10, adapted for clamping the daughter board 2 between the two clamping members 32, 33.

The first clamping member 32 generally formed as S shape includes: a first connecting lever 321 having a first pivot portion 321*a* secured to a side extension 320 formed on a side portion of the base portion 30, a first forearm portion 322 arcuately extending from the lever 321 to sinuously form a convex portion 323 and a concave portion 324 secured to the convex portion 323 and a first contact protrusion 325 formed on an end portion of the first forearm portion 322 contacting one (or left) side of the daughter board 2. A lower edge portion of the daughter board 2 is movably confined in the concave portion 324 of the first clamping member 32 between the first contact protrusion 325 and the convex portion 323.

The first connecting lever 321 is generally parallel to the base 30 as shown in FIG. 2. The side extension 320 is protruded upwardly from a left side portion of the base portion 30 to form an engaging portion 320*a* engageably held on a slot 11 in the connector base 1 and a stress protecting pad 320*b* formed on an opposite side of the engaging portion 320*a* having an inclination surface perspectively coincided with an inclined fixing protrusion or latch 12 of the connector base 1 for preventing an overstress caused to the first contact protrusion 325 when inclinedly biasing the daughter board 2 to be locked by the fixing protrusion or latch 12 as shown in arrow direction of FIG. 2.

The second clamping member 33 generally formed as L shape includes: a second pivot portion 331 formed on a side portion of the base portion 30, a second connecting lever 332 protruding upwardly from the second pivot portion 331 generally perpendicular to the base portion 30, a second forearm portion 333 secured to an upper portion of the second lever 332 generally perpendicular to the second lever 332, a second contact protrusion 334 formed on an end portion of the second forearm portion 333 contacting the other side of the daughter board 2 and defining an aperture 3*a* with the first contact protrusion 325 generally equal to a thickness of the daughter board 2, and a stress protecting protrusion 335 protruding outwardly from the second forearm portion 333 slidably engageable with a buffer recess 13 formed in an upper surface of the connector base 1, opposite to the stress protecting pad 320*b* formed on the side extension 320 of the first clamping member 32.

The first clamping member 32 is sinuously wound in the cavity 10 to be generally encompassed by the second clamping member 33 and is generally positioned under the second forearm portion 333 of the second clamping member 33.

For mounting the daughter printed circuit board 2 in the connector in accordance with the present invention, the daughter board 2 is first inclinedly inserted into the socket 10 of the connector base 1 to be clamped by the two clamping members 32, 33 of the contact element 3 as shown in dotted line of FIG. 2. The board 2 is then biased in an arrow direction (FIG. 2) to slightly depress the first contact protrusion 325 downwardly and to raise the second contact protrusion 334 slightly to be the solid line as shown in FIG. 2. When the second contact protrusion 334 is slightly raised, the protecting protrusion 335 will be retarded on the recess 13 to prevent an overstress exerting on the second forearm portion 333, thereby preventing its unexpected bending or deformation. Meanwhile, the stress protecting pad 320*b* formed on the first clamping member 32 may also retard the inclinedly moving daughter board 2 to prevent an overstress occurring on the first contact protrusion 325, thereby preventing a permanent set or deformation of the first clamping member 32.

The present invention is superior to a conventional electrical connector with the following advantages:

1. The clamping member, especially the S-shape clamping member 32 has a longer length for increasing a force arm for enhancing a clamping force of the two clamping members 32, 33 for clamping the daughter board 2 more firmly.

2. The longer clamping members 32, 33 will increase their flexibility, thereby compatible for a wide range of allowances of the thickness of inserted daughter boards.

3. Low insertion force for inserting the daughter board in the connector can be achieved for an assembly convenience.

4. Overstress on the contact element is protected to prevent permanent set or deformation of the element accordingly.

5. Either first or second clamping member can be biased independently for clamping the daughter board with the other clamping member by setting one of the two contact protrusions to be a fulcrum.

Figure 3:
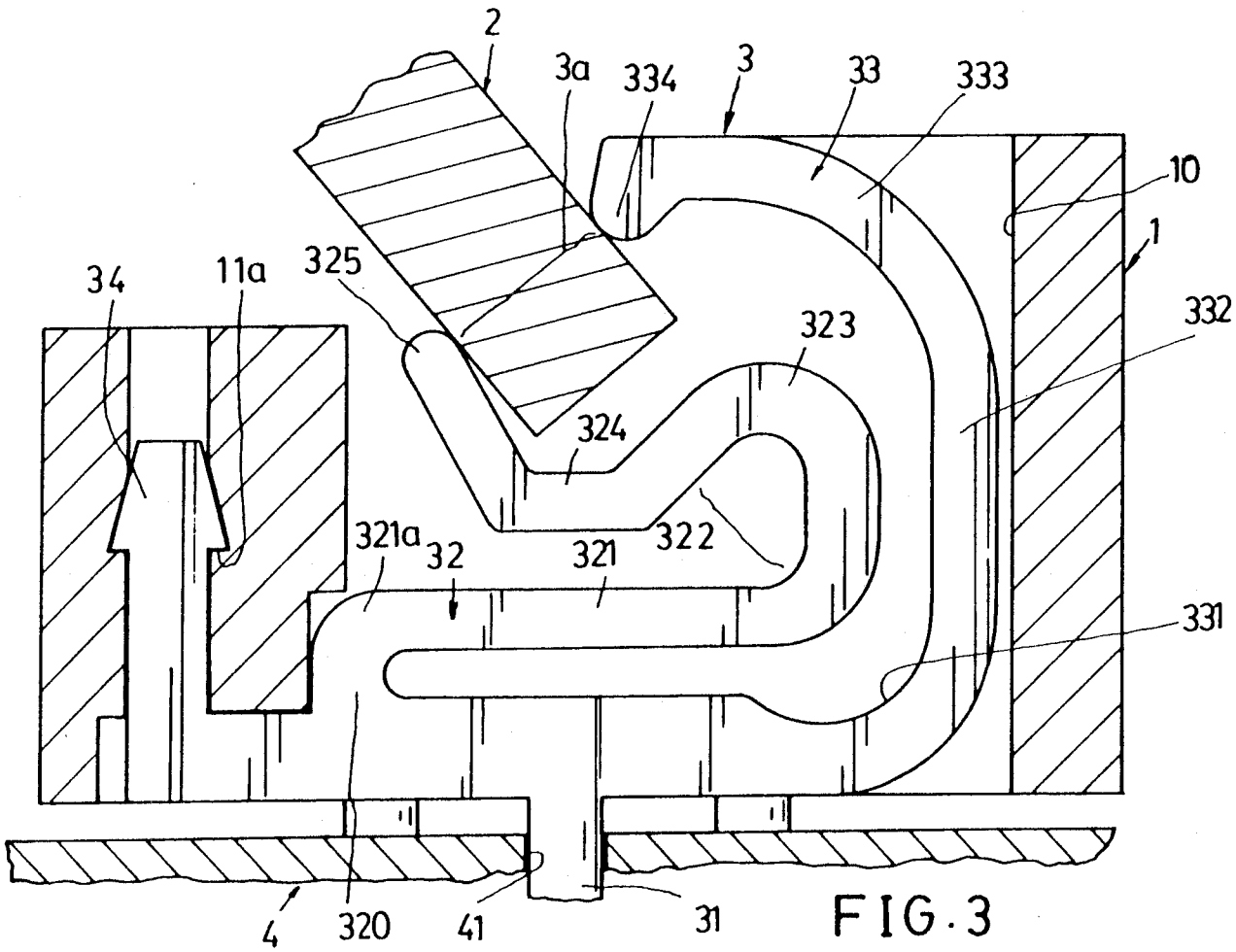
FIG. 3 is a sectional drawing of another preferred embodiment of the present invention.

Another preferred embodiment of the present invention is shown in FIG. 3, wherein the first pivot portion 321*a* of the first connecting lever 321 is formed as an arcuate portion secured to a short side extension 320 formed on the base portion 30. The overstress protecting means such as numerals 320*b*, 335 as shown in FIG. 2 has been changed in this modification. The embedding portion 34 is engaged with a recess 11*a* formed in the connector base 1. The second forearm portion 333 is arcuately extended from the second connecting lever 332 of which a second pivot 331 is also arcuately secured to the base portion 30.

Figure 4:
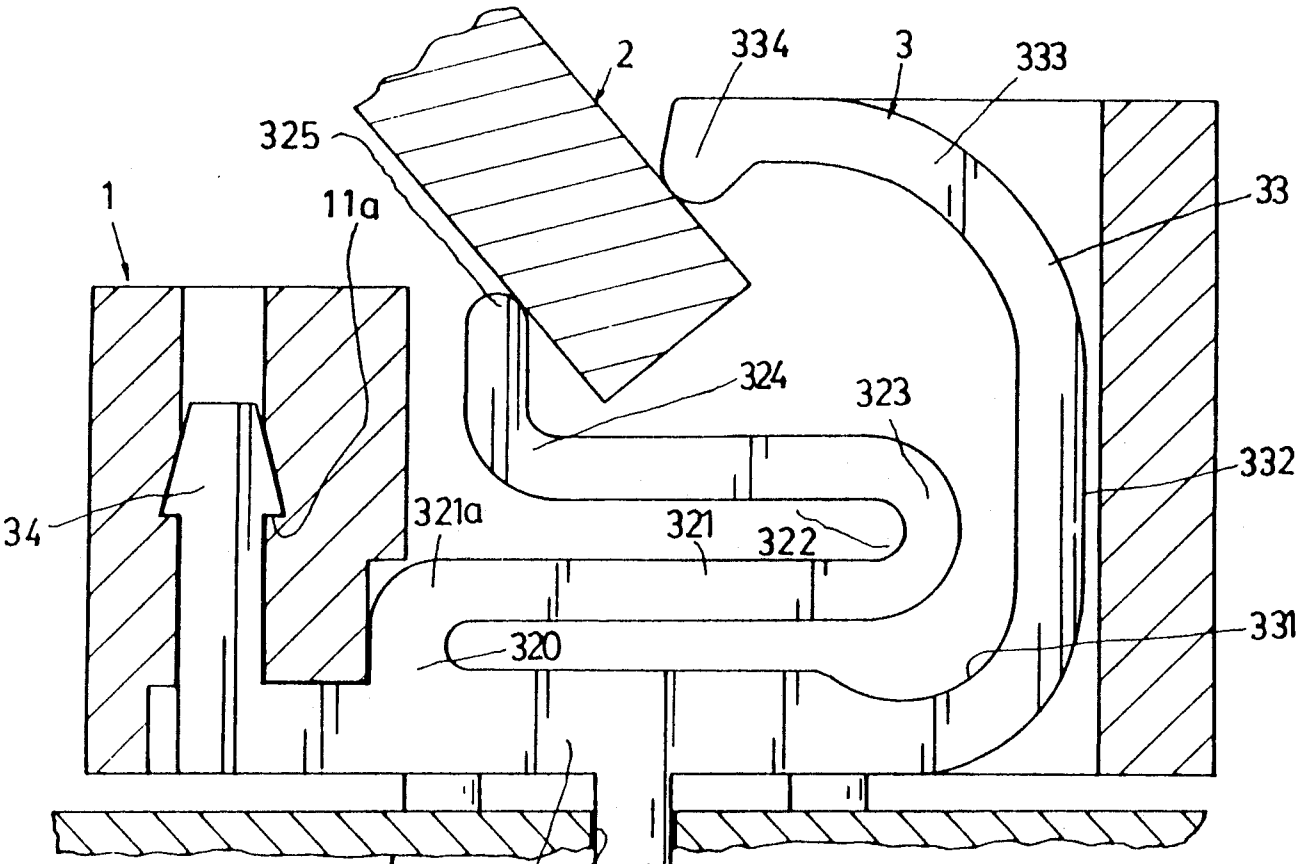
FIG. 4 is a modification of the embodiment as shown in FIG. 3 of the present invention.

As shown in FIG. 4, a first forearm portion 322 between the concave portion 324 and the convex portion 323 is made as a generally flat portion for an easier stamping production of the contact element 3.

Figure 5:
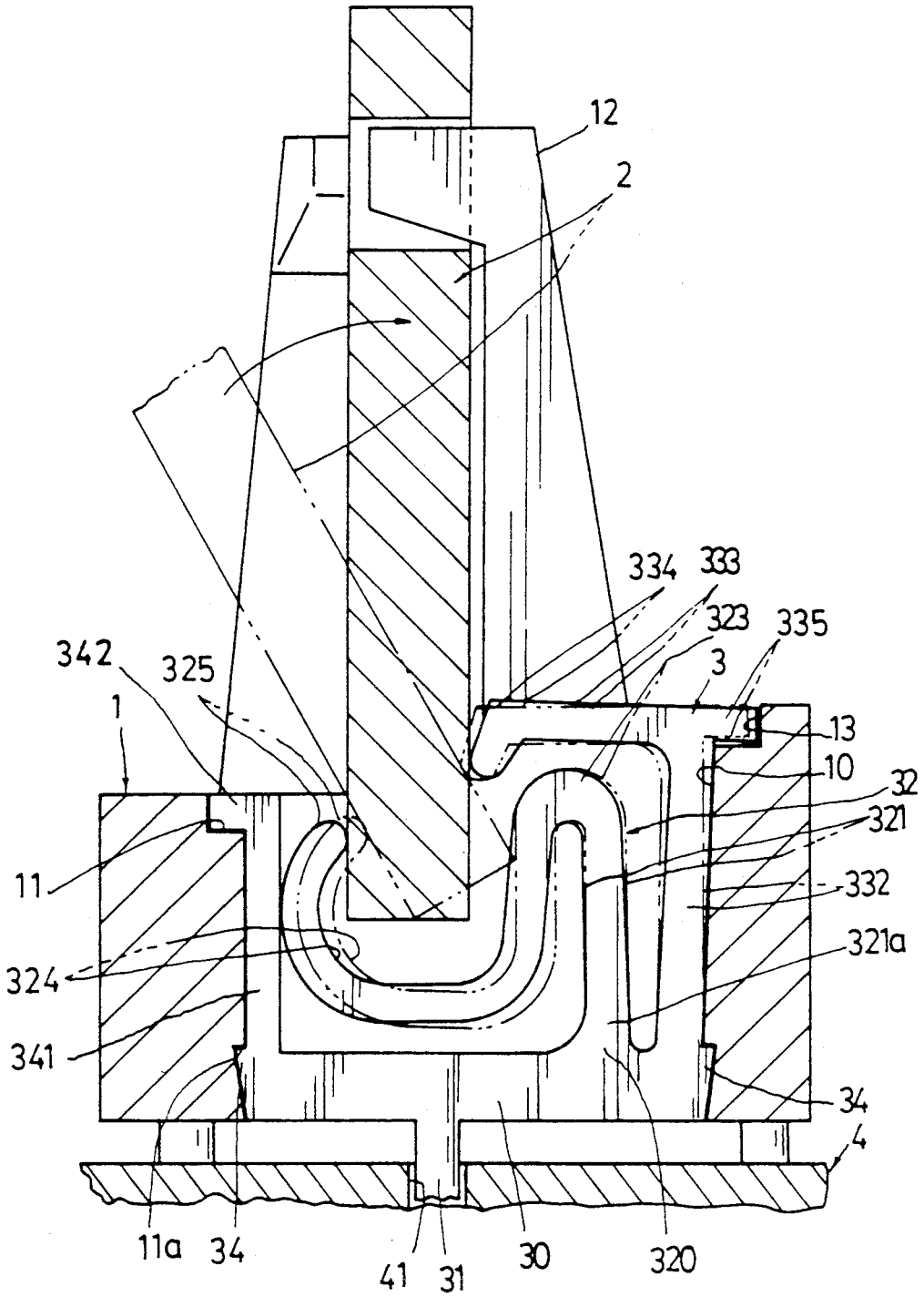
FIG. 5 shows still another preferred embodiment of the present invention.

As shown in FIG. 5, the present invention is adapted for inserting a daughter board 2 in a vertical latch 12, in which the first clamping member 32 includes the first connecting lever 321 directly protruded upwardly from a first side extension 320 formed on the base portion 30 adjacent and parallel to the second connecting lever 332 of the second clamping member 33. A second side extension 341 is protruded upwardly from the base portion 30 opposite to the first side extension 320 for embedding a left portion of the contact element 3 in the slot 11 of the connector base and also for limiting a downward movement of the first member 32. The second side extension 341 may be formed with an engaging portion 342 to be firmly engaged with an upper recess of the slot 11.

I claim:

1. A contact element used in an electrical connector comprising:

a base portion having a supporting leg member protruding downwardly from the base portion through a mother board, at least an embedding portion secured to said base portion engageably fixed in a slot transversely formed in a socket in a connector base, a first clamping member and a second clamping member respectively formed on said base portion for clamping a daughter board inserted in said socket in said connector base for electrically connecting said daughter board with said mother board, the improvement which comprises:

said first clamping member generally formed as S shape including a first connecting lever secured to a side extension formed on one side of said base portion, a first forearm portion arcuately secured to said first connecting lever having a convex portion and a concave portion secured to the convex portion, and a first contact protrusion formed on an end portion of said first forearm portion contacting one side of said daughter board;

said second clamping member including a second connecting lever secured to another side of said base portion generally perpendicular to said base portion, a second forearm portion secured to an upper portion of said second lever, and a second contact protrusion formed on an end portion of said second forearm portion contacting the other side of said daughter board for clamping said daughter board in cooperation with said first contact protrusion; and said first clamping member sinuously wound to have said first connecting lever and first forearm portion generally encompassed by said second clamping member, said concave portion of said first clamping member between said first contact protrusion and said convex portion generally confining a lower portion of the daughter board in said concave portion.

2. A contact element according to claim 1, wherein said first connecting lever is generally parallel to said base portion.

3. A contact element according to claim 1, wherein said first connecting lever is generally parallel to said second connecting lever.

4. A contact element according to claim 1, wherein said side extension of said first clamping member is protruded upwardly from one side of said base portion to form a stress protecting pad on an upper end portion of the side extension, said stress protecting pad perspectively coincided with a latch, which is provided for stably positioning and locking a daughter board inserted in said connector base, for limiting a biasing movement of the daughter board when inclinedly inserted in between two said clamping members of the contact element for preventing an overstress and permanent set of the first clamping member.

5. A contact element according to claim 1, wherein said second clamping member includes a stress protecting protrusion protruding outwardly from said second forearm portion to be slidably engaged with a buffer recess formed in an upper surface of said connector base for limiting an upward movement of the second forearm portion for preventing its permanent set.

* * * * *